US005745244A

United States Patent [19]

Svanqvist et al.

[11] Patent Number: 5,745,244

[45] Date of Patent: Apr. 28, 1998

[54] SCANNING DEVICE FOR SCANNING A PHYSICAL PROPERTY OF A FIBROUS WEB

[75] Inventors: Tord O. S. Svanqvist; B. Lennart H. Örtemo, both of Karlstad, Sweden

[73] Assignee: Valmet-Karlstad AB, Karlstad, Sweden

[21] Appl. No.: 689,467

[22] Filed: Aug. 9, 1996

[30] Foreign Application Priority Data

Sep. 13, 1995 [SE] Sweden ..... 9503173

[51] Int. Cl.[6] ..... G01N 21/86; G01N 21/89

[52] U.S. Cl. ..... 356/429; 162/263; 250/442.11; 250/559.48; 356/431

[58] Field of Search ..... 356/429, 431; 162/263; 250/442.11, 559.06, 559.48

[56] References Cited

U.S. PATENT DOCUMENTS

| | | | |
|---|---|---|---|
| 3,650,043 | 3/1972 | Overly et al. | 34/156 |
| 4,321,107 | 3/1982 | Page | 162/198 |
| 4,753,015 | 6/1988 | Eriksen | 34/23 |
| 5,164,048 | 11/1992 | Bossen et al. | 162/263 X |
| 5,233,195 | 8/1993 | Hellstrom et al. | 250/360.1 |

OTHER PUBLICATIONS

Valmet Automation Brochure: PaperIQ—The All-New Distributed Measurement System for Paper Quality [Undated].

Valmet Automation Brochure: IQScanner—The Platform for Valmet's Intelligent Sensor Family, Product No. F1000 [Undated].

Valmet Automation Brochure: IQWeight—A Member of Valmet's Intelligent Sensor Family, Product No. F1100 [Undated].

Valmet Automation Brochure: IQMoisture—A Member of Valmet's Intelligent Sensor Family, Product No. F1200 [Undated].

Valmet Automation Brochure: IQCaliper—A Member of Valmet's Intelligent Sensor Family, Product No. F1300 [Undated].

Valmet Automation Brochure: IQAsh—A Member of Valmet's Intelligent Sensor Family, Product No. F1400 [Undated].

Valmet Automation Brochure: IQColor—A Member of Valmet's Intelligent Sensor Family, Product No. F1500 [Undated].

*Primary Examiner*—Vincent P. McGraw

*Attorney, Agent, or Firm*—Bell, Seltzer, Park & Gibson

[57] ABSTRACT

The invention relates to a scanning device (1) for measuring physical properties of a moving fibrous web (2) which has two longitudinal edges and is intended to run in a predetermined path of movement past or through the scanning device (1). The device (1) has a carriage (11) carrying a scanning head (14). The carriage (11) is movably supported for movement transversely to the direction of movement of the web (2). A drive (12) is provided which imparts to the carriage (11) a reciprocating movement from one edge side of the web (2) to the other, during which the scanning of the web (2) is carried out. The scanning device (1) is fitted with means (21, 31, 32, 33, 36) associated with the carriage for providing, in essentially the same plane as the predetermined path of movement of the web (f), a planar web supporting surface at locations between the carriage (11) and the two longitudinal edges of the web (2) during passage of the web (2) past the scanning device (1). The invention reduces the occurrence of web breakage and improves the accuracy of the measurement.

10 Claims, 7 Drawing Sheets

SCANNING DEVICE FOR SCANNING A PHYSICAL PROPERTY OF A FIBROUS WEB

FIELD AND BACKGROUND OF THE INVENTION

This invention relates to scanning devices having measuring means, e.g. scanning heads or gauging heads for scanning a physical property of a running fibrous web, such as a paper web, in order to monitor for example caliper, moisture content, basis weight, ash content, or color, opacity and brightness. The invention more specifically relates to a device having a supporting structure such as a frame for movably supporting at least one carriage for a scanning head which will scan the running web as the web moves in a predetermined path of movement through or past the frame. In operation, the carriage with its scanning head will move transversely to the direction of movement of the web in a reciprocating movement from one longitudinal edge of the web to the other. During the reciprocating movement of the carriage, the scanning head will scan the web in order to detect the properties of the web.

The performance of a paper machine, such as a tissue machine, is often limited by its dry end. In the dry end, several causes may result in web breaks, and the produced web may be rejected for unsatisfactory quality. The main factors affecting dry end machine efficiency are lost time with no paper on the reel, and the amount of paper rejected at paper breaks. On most high speed machines the paper web roll is kicked out at a paper break, because it is difficult to make a turn-up on a half size roll, and if the roll is to small, the roll is rejected. One cause for web breaks is that when a web runs unsupported between two successive sections in a paper machine, disturbing air currents will frequently result in turbulence and web flutter that sometimes causes the web to break. Such currents can originate from the machine room, the boundary layer of air and the rotating rolls of the paper machine. A section of the web path where the web runs unsupported is sometimes referred to as "an open draw".

It is known that in order to reduce web breakage, the web can be stabilized or supported in its path by flutter suppressors that support the web in its path. Such flutter suppressors might be realized in the shape of plates or foils extending over the width of the predetermined path of the web. When a web is made to run along and in adjacently spaced facing relation to a flutter suppressor in the shape of a plate, the boundary layer of air between the flutter suppressor and the web will be reduced and stabilized. Thereby, the tendency of the web to flutter will be reduced. Web stabilizers or flutter suppressing foils are disclosed in U.S. Pat. Nos. 4,321,107 (Page) and 3,650,043 (Overly et al.), for example. A section of the web path where the web runs supported is sometimes referred to as "a closed draw".

At the dry end of a paper machine, the web will frequently pass a scanning device for monitoring such factors as moisture or basis weight. Scanning devices for moving webs are disclosed in U.S. Pat. Nos. 5,164,048 (Bossen et al.) and 5,233,195 (Hellstrom et al.), for example. The above-mentioned U.S. Pat. No. 4,321,107 discloses that a tissue paper web passes from a Yankee cylinder past a suppressing foil, through a scanner and then past a second suppressing foil. According to this document, the scanner constitutes an intervening element (see FIG. 1) between the suppressing foils. The part of the web path where the web is scanned will therefore constitute an open draw. Of course, if a scanner is to be applied to a part of the web path, the scanning must not be obstructed by any object such as a suppressing foil. However, the part of the web path where the web passes a scanner will be more prone to web flutter and web breakage than those parts of the web path where the web can be supported in by a suppressing foil or a similar element. The distance that the web crosses during the passage of the measuring frame is of course relatively short, but it is still wide enough to be able to cause undesired flutter. An additional disadvantage of the web flutter caused by the open draw, is that the measurement of web properties will be less accurate.

SUMMARY OF THE INVENTION

The object of the present invention is to reduce the occurrence of web breakage caused by web flutter when the web passes a scanning device. An additional object is to increase the accuracy of the scanning operation. In accordance with the present invention, these objects are achieved by using in a scanning device for scanning a physical property of a fibrous web, means for providing a web supporting surface that supports the web during its passage of the scanning device and reduces web flutter.

Scanning devices of the kind referred to in this application commonly includes a substantially rectangular frame, sometimes referred to as an O-frame, having a central opening for the passage of a web therethrough and scanners movably supported by the frame for movement across the web. Scanning devices of this kind can be exemplified by the one marketed by Valmet Automation under the trade name "PaperIQ". In the context of this application, the invention will be described with reference to a scanning device having an O-frame. However, other types of supporting structures or frames are also known, and it should be understood that the invention is equally applicable to those other types as well. In the embodiments disclosed in this application, the scanning device includes an O-frame having two vertical beams interconnected by an upper and a lower horizontal beam. Each of the horizontal beams is provided with a movable carriage on which a measuring means such as a scanning head is fastened. The carriages with their measuring means will be in vertical alignment with each other and arranged to move in synchronization with each other so that the scanning heads can work together as one unit when a web to be scanned is made to travel in a predetermined path of movement between the scanning heads. Such a unit works in the way that a signal, such as a beam of beta particles in case of measuring basis weight, is emitted from one of the scanning heads and passes through the web where the signal is attenuated by absorption. The attenuated signal is then received by the opposing scanning head which compares the received signal with a reference value. For measuring moisture, an infrared beam is preferred; for ash content, x-rays; for color etcetera, light from a xenon flash lamp rich in ultraviolet light; and for measuring caliper, it is preferred to monitor the magnetic flux density in a magnetic circuit. Since the exact function of the measuring is no part of the present invention both the emitting and the receiving unit have, for the sake of convenience, been termed scanning heads in this application. When the running web passes through or past the scanning device, the carriages will move continuously back and forth, transversely to the direction of the moving web, from one longitudinal edge of the web to the other. During their travel back and forth the scanning heads will scan the moving web to detect sheet caliper, moisture content, basis weight and other properties of the web.

According to the invention the scanning device further comprises means for supporting the web during the passage of the web through or past the frame and at the same time offer an unobstructed line of sight between the moving web and the scanning head. In order to achieve this function, the inventors have created means for providing, in essentially the same plane as the predetermined path of movement of the web, a planar web supporting surface at locations between the carriage and the longitudinal edges of the web.

In a preferred embodiment of the invention a carriage with its scanning head is connected, on each side of the carriage, to a flexible belt which has a width substantially equal to the width of the gap that the web would otherwise have to cross. The belt is connected on each side to the vertical beams. More precisely, the vertical beams carry spools or rolls for coiling and uncoiling the belt. When the carriage with its scanning head is moved away from one of the vertical beams towards the other beam, the belt will be uncoiled from the drum on the vertical beam that it is moving away from and coiled on the drum on the opposite side. It is to be noted that the movement of the carriage is not effected by the coiling and uncoiling action but is achieved by a drive or motor acting on the carriage which is preferably situated on the supporting structure of the frame. When the carriage with its scanning head now moves over the running web, the belt will move together with the carriage in such a way that during its entire passage through the measuring frame, the running web will be supported by the belt and yet, there will be no obstruction between the sensing means and the web. In this way, the provision of a closed draw through the scanning device will prevent sheet breakage and result in a more accurate measuring of the web.

In a second embodiment of the invention, the inventors envisage that instead of a belt which is wound and unwound, the web supporting means can be realized in the shape of telescopic elements such as thin slidable lamellae interconnected at their ends.

In a third embodiment of the invention, the web supporting means takes the form of a flexible belt which is not coiled or uncoiled, but forms a partial loop around the carriage in such a way that when the carriage moves over the web, the belt does not travel with the carriage. Instead, the belt is deflected around the carriage when the carriage moves over the web.

In a fourth embodiment of the invention, the web supporting means might consist of separate sections of resilient elements such as spring-loaded plates. In this embodiment of the invention the carriage will be provided with deflecting means shaped to co-operate with the plates in such a way that during the passage of the carriage over the web, it will force the plates aside against the force of the springs. When the carriage has passed such a plate the plate will resume its ordinary position and perform its web supporting function.

The invention will be described below in more detail with reference to the appended drawings, which illustrate various specific embodiments of the invention.

DETAILED DESCRIPTION OF THE ILLUSTRATED EMBODIMENTS

Figure 1A:
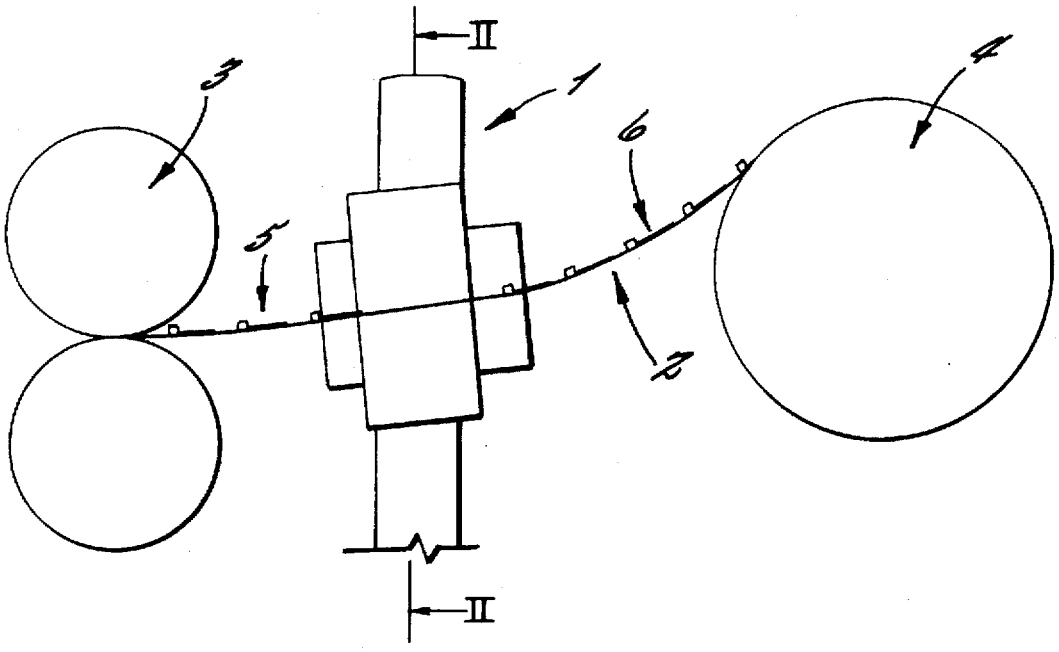
FIG. 1*a* is a side view showing a scanning device placed between two work stations for a running web.
Figure 1B:
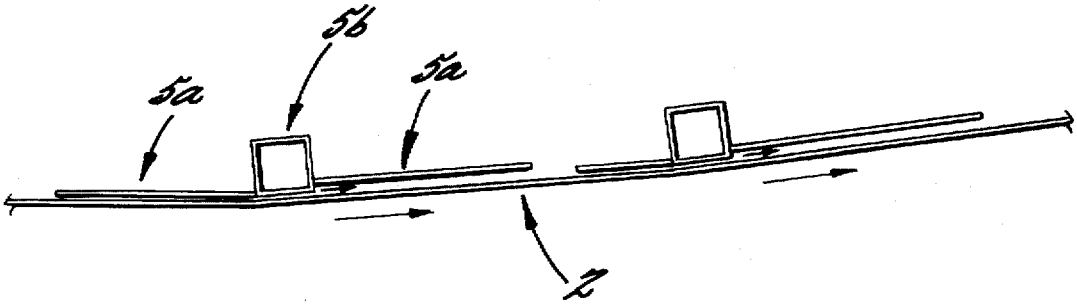
FIG. 1*b* is a side view showing in greater detail a part of the web path upstream of the scanning device.
Figure 3:
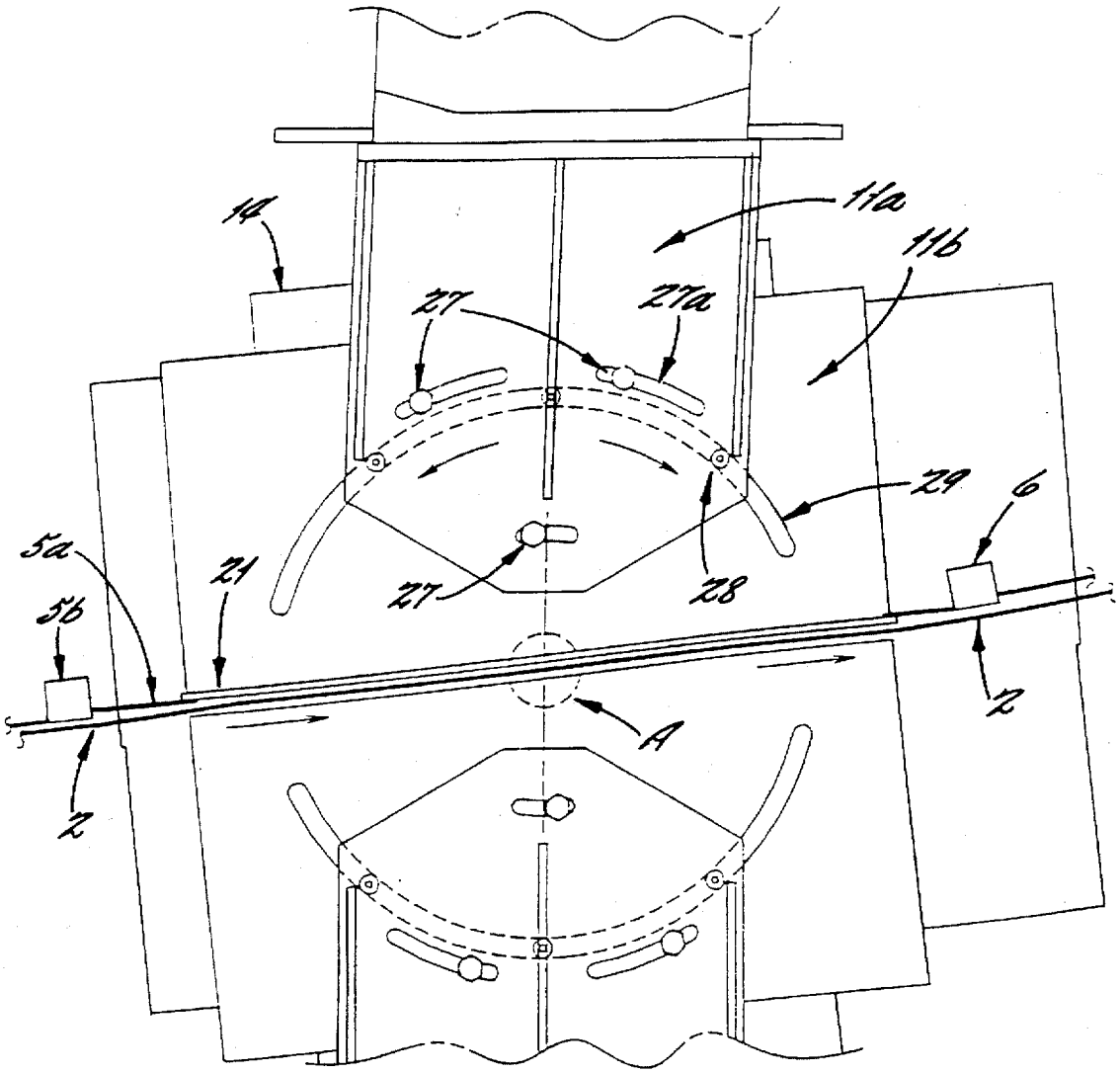
FIG. 3 is an enlarged sectional view taken along line III—III in FIG. 2.

With reference to FIG. 1*a*, a scanning device generally designated 1 receives a running paper web 2 having two longitudinal edges. The web is delivered from a previous work station such as a pair of calender rolls 3 and runs in a predetermined path of movement through or past the scanning device where measurements are carried out. From the scanning device, the web will continue to the next work station such as a reel-up 4. As shown in FIGS. 1 and 3, the paper web is delivered to the scanning device over a means 5 for providing a web supporting surface. The means 5 for providing a web supporting surface comprises a number of consecutive substantially web-wide plate members 5*a*, extending over the width of the intended path of movement of the web, and pipe members 5*b*, likewise extending over the width of the intended path of movement of the web. The plate members are located adjacent the predetermined path of movement of the web. The pipe members are placed as interconnecting members between consecutive plates, and each pipe member extends slightly beyond the plane of its downstream plate. In this way, when the moving paper web passes one of the pipe members, the transition between the pipe member and its downstream plate will create a zone of reduced pressure which will draw the web towards the plate and thus improve adherence between the web and the web supporting surface. For stabilizing a web and particularly for the purpose of tail threading, the pipe members are connected to a source of pressurized air and have elongate slits or orifices (not shown) facing in the direction of movement of the web. As indicated in FIG. 1*b*, which shows part of the web path between the calender rolls and the scanning device, air under pressure is discharged from the slit or orifices in the direction of movement of the web. The stream of pressurized air will then follow the web supporting surface and run between the web and the web supporting surface. The stream of pressurized air will entrain the web and assist in bringing the web forward. The flow of air will form, between the web and the supporting surface, an air layer of reduced static pressure which will stabilize the web against flutter. The web passes from the means 5 for providing a web supporting surface through the scanning device to a downstream means 6 for providing a web supporting surface. The means 6 are similar to the means 5 and need not be further described.

Figure 2:
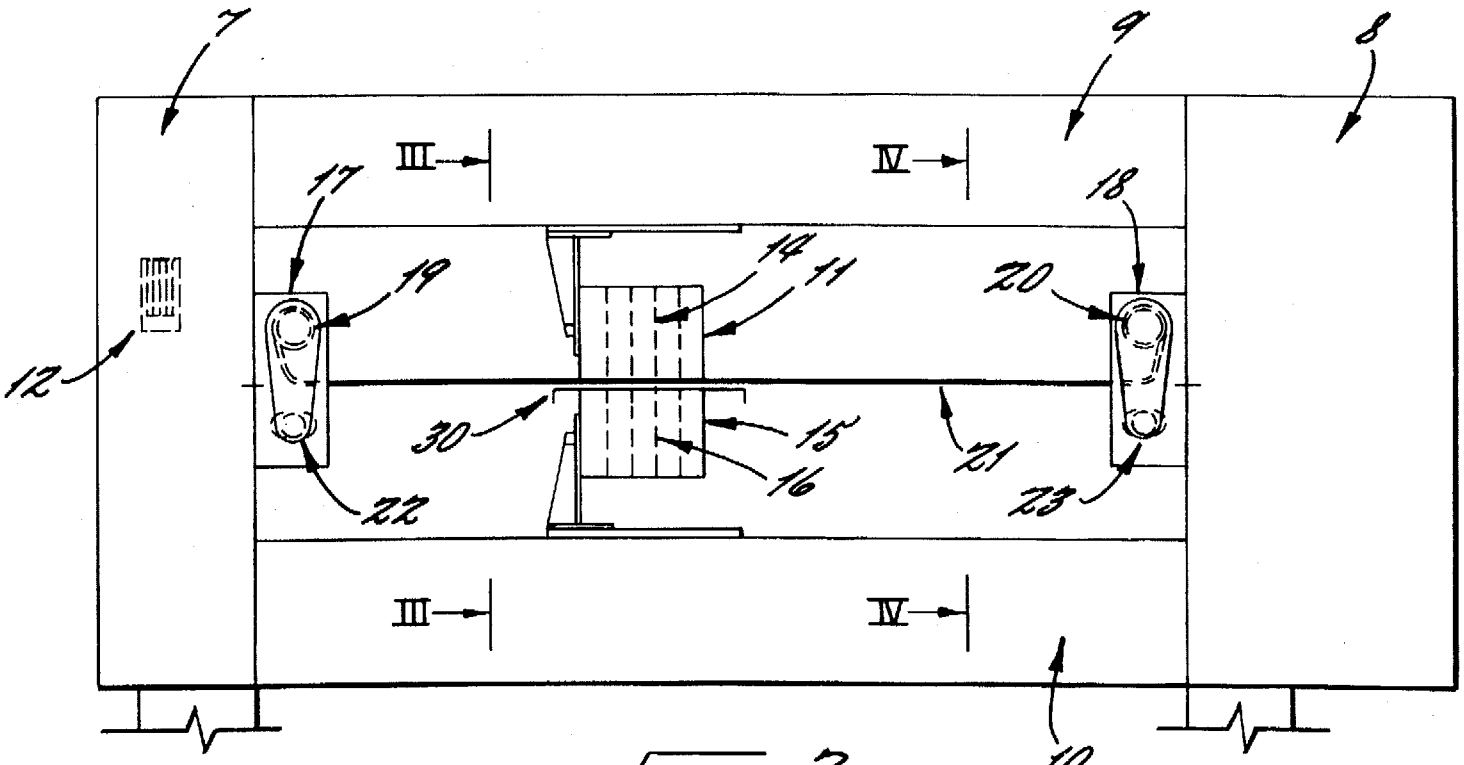
FIG. 2 is a cross section view taken along line II—II in FIG. 1*a*.

As best seen in FIG. 2, the scanning device may include an O-frame having a first and a second vertical beam 7 and 8 interconnected by an upper and a lower horizontal beam 9 and 10. The upper beam supports a carriage 11 that is movable on the beam 9 along a track such as a linear bearing (not shown). The carriage is driven by a drive means or motor 12 mounted on the frame through a transmission such as a toothed belt (not shown) which connects the carriage with the motor. Mounted on the carriage is an upper scanning head 14 for measuring or scanning the web. The carriage includes at least one bracket 11*a* which carries a box or box-like structure 11*b* (shown in more detail in FIG. 3) containing the scanning head which includes one or several emitting or receiving units facing against the web. In a similar way, the lower beam 10 supports a movable carriage 15 which is similar to the carriage 11 and has a lower scanning head 16. In the same way as the upper carriage 11, the lower carriage 15 is movable along its beam 10 along a linear bearing and is arranged to be driven by motor 12 through a transmission such as a toothed belt. The carriages are placed in vertical alignment with each other. In operation, the movable carriages 11 and 15 will move in synchronization with each other to permit their respective scanning heads, 14 and 16 to function together as one unit. The function of the scanning heads belongs to the prior art and will not be further discussed.

Figure 4:
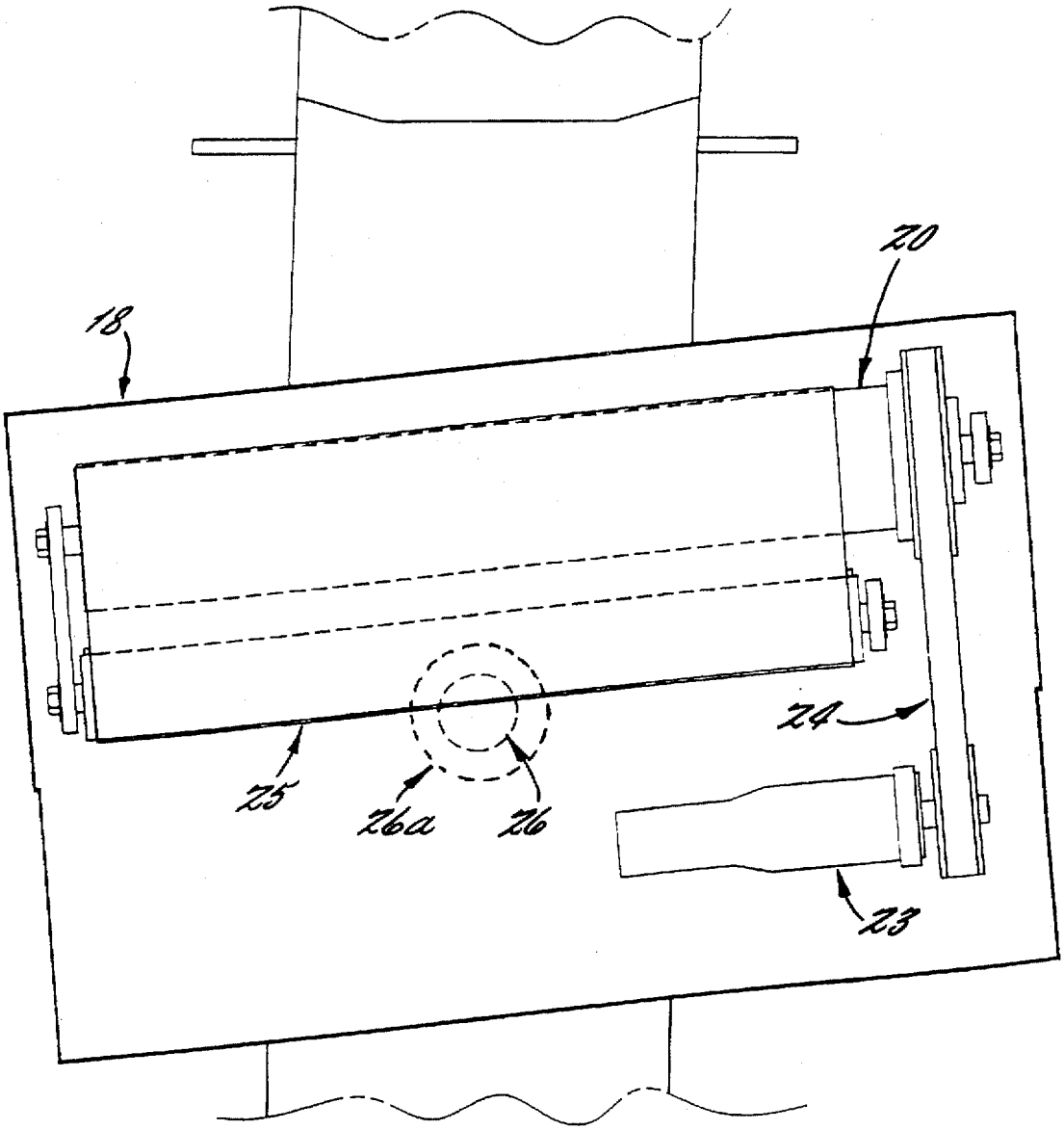
FIG. 4 is an enlarged sectional view taken along line IV—IV in FIG. 2.

In a preferred embodiment of the invention, the vertical beams 7 and 8 are provided with housings 17 and 18 that enclose coiling/uncoiling rolls 19 and 20. Each roll is connected to one end of a flexible belt 21 which extends between the housing 17 on the first vertical beam and the housing 18 on the second vertical beam. As shown in FIG. 2, the belt 21 will lie in the path of movement of the upper carriage 11 with its scanning head 14 and is in fact coupled to the lower part of the upper carriage with its scanning head in such a way that the lowest part of the carriage can be viewed as a part of the belt structure. The belt will thus form a supporting surface in a position adjacent or in essentially the same plane as the predetermined path of movement of the web. To ensure appropriate tension in the belt, the housings 17 and 18 are provided with belt tensioning means which could advantageously take the form of air motors 22 and 23 acting on the rolls 19 and 20 through a transmission such as a belt 24 as indicated in FIG. 4. As further indicated in FIG. 4, when the belt 21 runs in or out of one of the housings 17 and 18, it will pass over a lower deflection roll 25.

As indicated in FIGS. 1, 3 and 4, the carriage and the housings 17 and 18 are slightly inclined with respect to the horizontal plane since the web will be running in a slightly curved path. As indicated in FIG. 4, each housing is mounted on a shaft 26 which is fixedly mounted on the frame. The housings are fastened on the shaft 26 by means of a clamping connection symbolically indicated at 26*a*. By loosening the clamping connection it will be possible to pivot a housing on the shaft 26 and thereby adjust the angular position of the housing. In a similar way, indicated in FIG. 3, the upper carriage has a bracket 11*a* on which a box 11*b* containing the scanning head is mounted. The box is fixed to the bracket by means such as a bolt and nut 27 extending through a semicircular slot 27*a* in the bracket 11*a* and fastened in the box 11*b*. A pin 28 projecting from the bracket is arranged to fit in a semicircular groove 29 in the box 11*b*. By loosening the bolts, it will be possible to pivot the box part of the carriage with respect to the bracket. Thereby, the inclination of the box part with its scanning head can be varied with respect to the horizontal plane. The lower carriage 15 is constructed in the same way. As can be seen in FIG. 3, the groove 29 can be thought of as part of a circle having its center at the imaginary axis A. When the box parts of the carriages are pivoted, they will thus pivot around the imaginary axis A. Since the housings 19, 20 are also mounted in a way which permits them to be pivoted, it is possible to ensure that both the belt and the scanning heads will be at a right angle to the web which is to be scanned regardless of what exact path the web is made to follow.

In operation, the scanning device with its web supporting belt will function in the following way. The paper web runs towards the scanning device supported by the means 5 for providing a web supporting surface and is delivered from the support 5 to the scanning device where it will pass between the upper and the lower scanning head. As best seen in FIG. 3, the belt 21 connects with the means 5 and 6 for providing a web supporting surface in such a way that a trailing end of the means 5 slides under an upstream edge of the belt 21 and an downstream edge of the belt 21 slides under a leading end of the means 6.

In the scanning device, the motor 12 imparts to the carriages 11 and 15 with their scanning heads 14 and 16 a reciprocating movement transversely to the direction of movement of the web, from one longitudinal edge of the web to the other. When the carriage 11 with its scanning head 14 moves over the paper web in a direction away from the vertical beam 7 towards the vertical beam 8, the belt, which is coupled to the carriage, will follow the carriage in the movement of the carriage over the web. The belt will then be coiled on the roll 20 on vertical beam 8 and uncoiled from the roll 19 on vertical beam 7. The belt will thus be able to move together with the carriage and will provide, at locations between the carriage and the longitudinal edges of the web, a planar web supporting surface for the web during the passage of the web through the scanning device. As the paper web leaves the supporting surface 5, it will be received by the belt 21 which will function as a supporting surface for the paper web. The paper web will then pass through the measuring zone and continue to the supporting surface 6 that is associated with the belt 21. During the passage of the web through the measuring zone, the web will be supported in its path by the belt 21, and possibly further stabilized in its path by a flow of air discharged from the pipe member 5*b* immediately upstream of the scanning device, the flow of air running between the belt 21 and the web. In this way the whole path of movement of the web through the scanning device will constitute an uninterrupted closed draw, yet the scanning head will not be obstructed by any object between the head and the traveling paper web.

Although not part of the invention, an additional feature of the scanning device will now be explained with reference to FIG. 2. When the carriages with their scanning heads have extended their movement beyond a longitudinal edge of the web, the scanning heads will sense that the web no longer occupies the space between the scanning heads. A signal will then be transmitted from one of the scanning heads to a control unit (not shown) which controls the motor 12. The control unit will then stop the motor for a brief moment during which the drive of the motor will be reversed. The carriages with their scanning heads will then be driven in the opposite direction. As indicated in FIG. 2, the lower carriage is provided with a curved plate 30. The reason for this is that when the carriages have extended their movement beyond the edges of the web and are thus in a position to move back over the web, it will be necessary to ensure that the web is properly guided in between the carriages with their scanning heads. The curved plate 30 will guide the web in between the carriages.

Figure 5A:
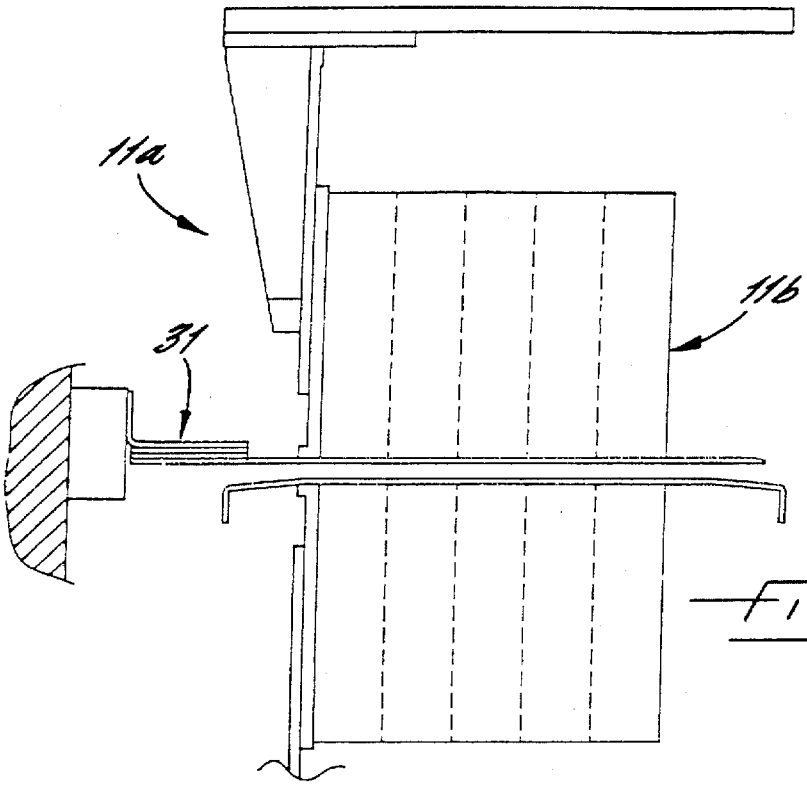
FIG. 5*a* shows in a view similar to FIG. 2, a second embodiment of the invention where a carriage with its scanning head has reached an end position during its reciprocating movement across the web.
Figure 5B:
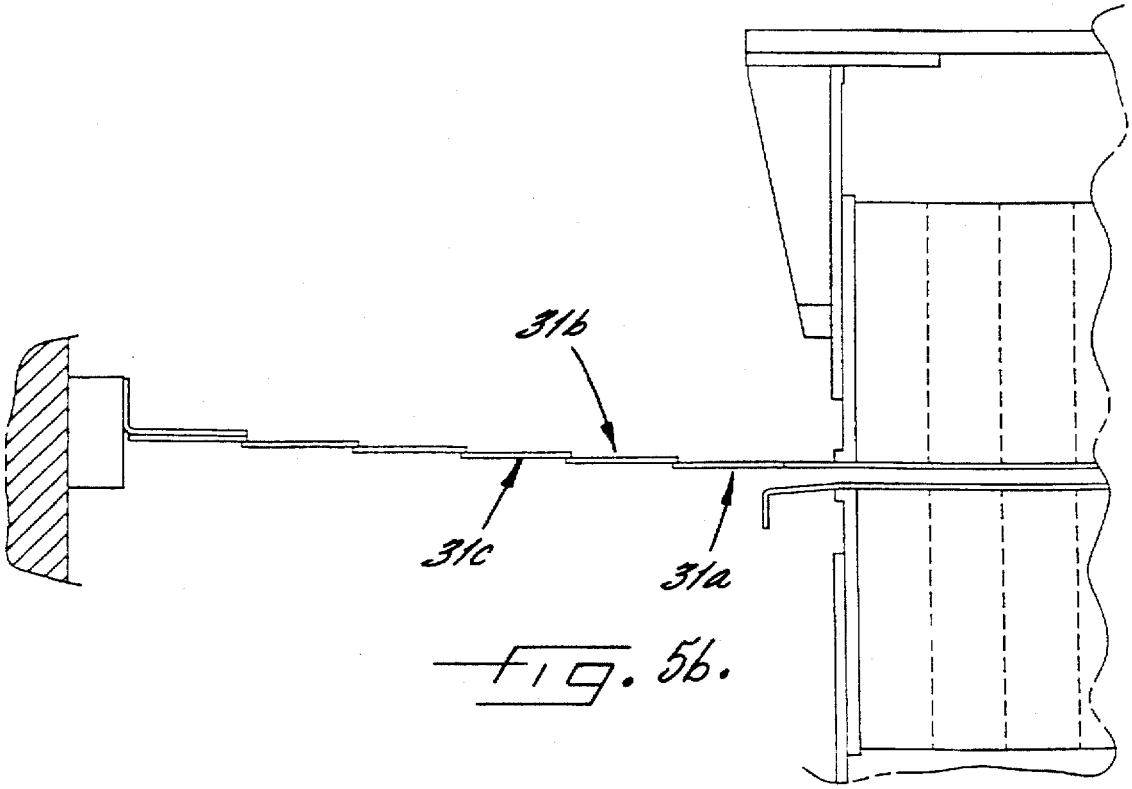
FIG. 5*b* is a view similar to FIG. 5*a* showing the carriage in an other position.

A second embodiment of the present invention will now be described with reference to FIGS. 5*a* and 5*b*. In this embodiment, the flexible belt of the first embodiment has been replaced by telescopically slidable interconnected members 31 that may be in the shape of thin lamellae 31*a*, *b*, *c* etc. connected at their ends. Each telescopic member 31 is connected at one end to the carriage with its scanning head and at its other end to a pivotally mounted housing on one of the vertical beams. In FIGS. 5*a* and 5*b*, only the telescopic member 31 on one side of the carriage is shown. It is to be understood that there are two telescopic members, one on each side of the carriage. When the scanning head moves from one longitudinal edge of the web to the other, one of the telescopic members 31 will be extended and the other one will be contracted or compressed. The telescopic members 31 will provide a web supporting surface for the paper web in the same way as the belt 21 of the first embodiment and provide a closed draw for the paper web.

Figure 6:
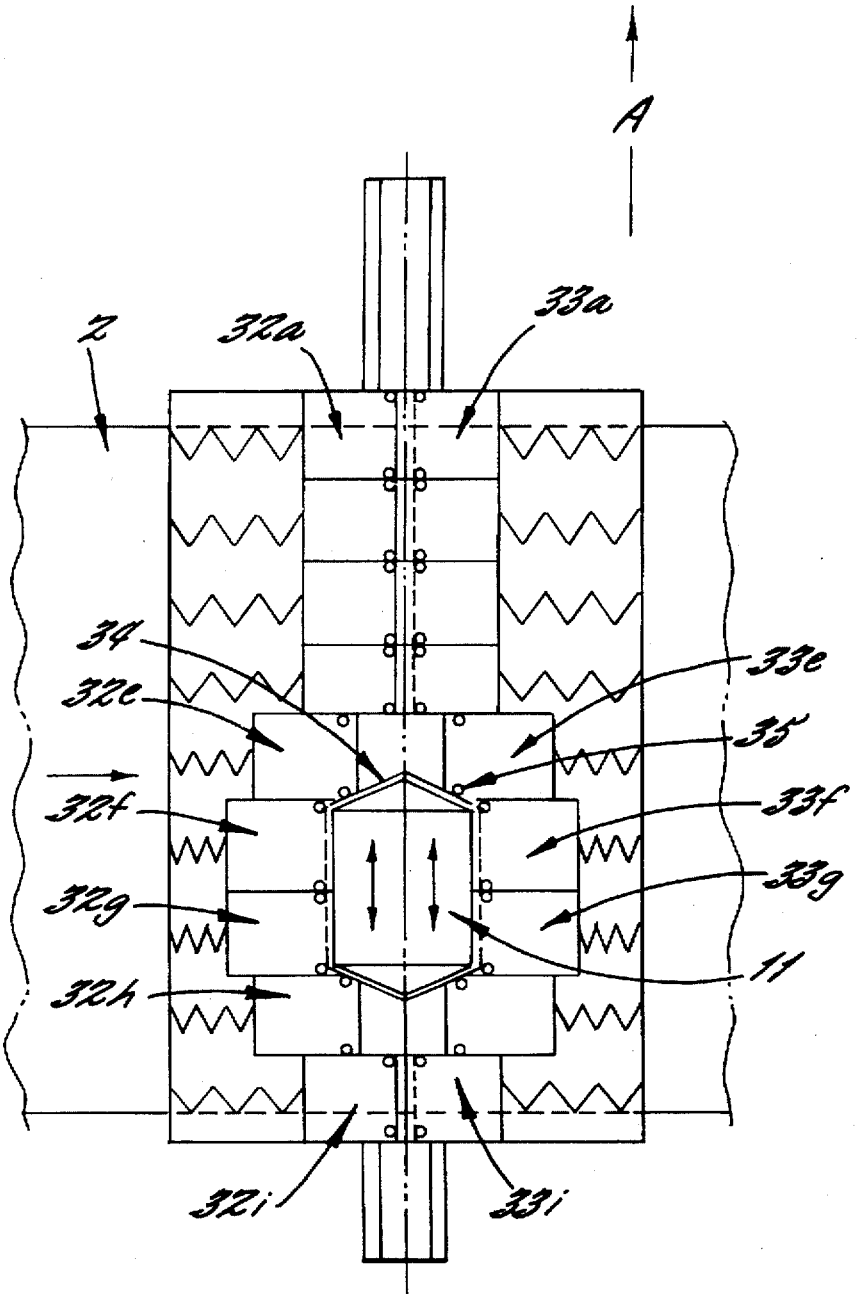
FIG. 6 is a view from above showing a third embodiment of the invention.

In a third embodiment shown in FIG. 6 in a view from above, the web supports are not coupled to the carriage and will not follow the carriage in its movement over the web. Instead the means for providing the web supporting surface in the measuring zone is constituted by elements which will be deflected by the carriage with its scanning head during the movement of the carriage over the running paper web. As shown in FIG. 6, the supporting elements may be formed by two opposed rows of spring-loaded plates, 32*a* to 32*i* and 33*a* to 33*i*. In this embodiment the carriage is provided with a deflecting element 34 having an inclined surface which in operation will co-operate with contact elements such as rolls 35 on the plates 32 and 33. When the carriage and the scanning head move over the measuring zone, the inclined surface 34 will act on the rolls to force the plates 31 and 32 against the force of the springs away from the path of movement of the scanning head. In FIG. 6, the carriage is moving in the direction of arrow A and the plates 32*e* and 33*e* have begun to be deflected away from the path of movement of the carriage, plates 32*f*, 32*g* and 33*f*, 33*g* have been completely forced away from the path, plates 32*h* and 33*h* have begun to move back from a deflected position to a position for supporting a paper web moving through the scanning device and plates 32*i* and 33*i* are shown as being completely back from their deflected position to their web supporting position. The plates will thus be in a position to support the paper web during the passage of the web through the scanning device, yet the scanning head will not be obstructed by the plates.

Figure 7:
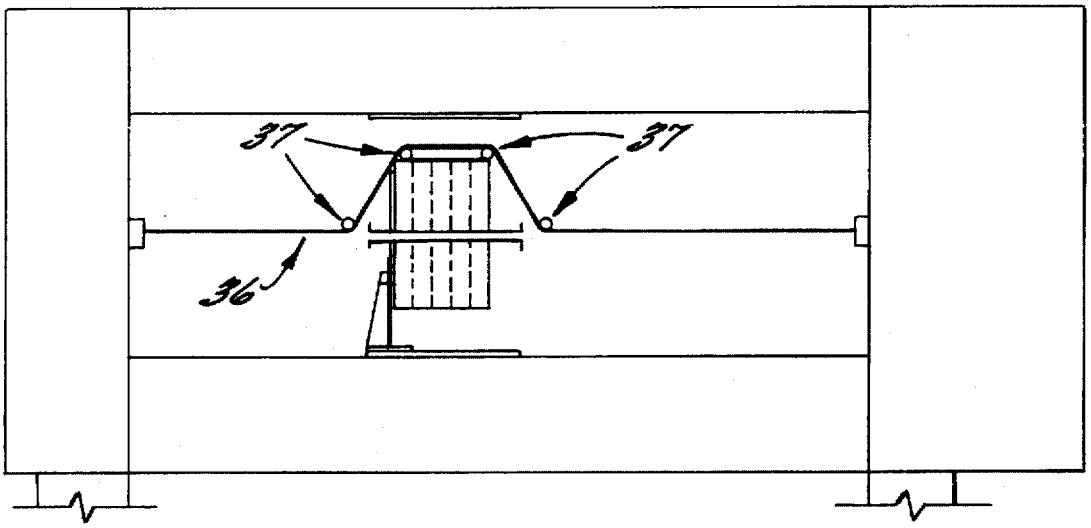
FIG. 7 is a view similar to FIG. 2 showing a fourth embodiment of the invention.

A fourth embodiment of the invention will now be explained with reference to FIG. 7.

The principle of letting the means for providing the web supporting surface be deflected by the carriage is here realized by using a stationary flexible belt 36 which extends between the first vertical beam 7 and the second vertical beam 8 and is fixedly connected at each end to a pivotally mounted housing on one of the beams. The belt is arranged to extend in a partial loop around the carriage between belt contacting guide rolls 37 mounted on the carriage. The guide rolls are arranged to contact the belt on both sides of the belt and force the belt to extend in a partial loop around the carriage. The spacing of the rolls with regard to the carriage can be varied in order to use the rolls as belt tensioning means. For geometrical reasons, the connection between the bracket and the box of the carriage can not be identical to the embodiment shown in FIG. 4 but will have to be adjusted as will be appreciated by those skilled in the art. During movement of the carriage over the web the belt will not move together with the carriage and any given section of the belt will remain stationary until reached by the carriage. When the carriage reaches a section of the belt, that section will be deflected around the carriage in the partial loop formed by the belt around the carriage. The belt will thus be able to provide a web supporting surface but will not constitute an obstacle for the scanning heads.

Thus, the invention consists in arranging for a running fibrous web, an uninterrupted closed draw through a scanning device by means for providing a web supporting surface that will support the paper web and yet not obstruct the scanning head. The invention is materialized in the shape of a means for providing a web supporting surface that is associated with a carriage carrying the scanning head, either in the way that the means for providing the web supporting surface moves together with the scanning head or, alternatively, is deflected when the scanning head moves over the running paper web. The principle of letting the means for providing the web supporting surface move together with the carriage can of course be implemented in other ways than those shown in this application, for example, the flexible movable belt that has been described does not need to be coiled/uncoiled but could be an endless belt forming a loop around a part of the frame of the scanning device. The principle of letting the means for providing the web supporting surface be deflected has been shown in embodiments where the movement of the carriage with its scanning head itself causes the deflection, but of course the essential point is that the deflection is synchronized with the movement of the scanning head. Those skilled in the art to which the invention pertains will easily see other ways of embodying this principle. The supporting structure which has been described in the shape of a rectangular frame, i.e. an O-frame, could of course assume many other shapes.

The invention reduces the occurrence of web breakage and improves the accuracy of the scanning or measuring.

That which is claimed is:

1. A scanning device for scanning at least one physical property of a moving fibrous web, such as a paper web, which has two longitudinal edges and is intended to run along a predetermined path of movement past the device, said device comprising:

(a) a scanning head;

(b) at least one carriage for carrying the scanning head;

(c) a support supporting the carriage for movement transversely to the direction of movement of the web;

(d) a drive for imparting to the carriage with its scanning head a reciprocating movement transversely to the direction of movement of the web, from one longitudinal edge of the web to the other; and (e) means associated with the carriage for providing, in essentially the same plane as the predetermined path of movement of the web, a planar web supporting surface at locations between the carriage and the two longitudinal edges of the web during passage of the web past the device.

2. A device according to claim 1, wherein the means for providing the planar web supporting surface is coupled to the carriage and follows the carriage with its scanning head in the reciprocating movement of the carriage.

3. A device according to claim 2, wherein the means for providing the planar web supporting surface comprises a flexible movable belt which is arranged to follow the scanning head as it traverses the web, and wherein mounted adjacent the predetermined path of movement of the web, on each side of the web, there is a roll upon which the belt is coiled at one end and uncoiled at the other end when the carriage with its scanning head traverses the web.

4. A device according to claim 3, wherein the device includes a frame having:

(a) two horizontal beams, one placed under the intended path of movement of the web and one placed over the intended path of movement of the web;

(b) two vertical beams, one on each side of the intended path of movement of the web, the vertical beams being interconnected by the horizontal beams;

(c) a housing mounted on each of the vertical beams, each housing containing one of the rolls for coiling the belt and a motor for tensioning the belt; and (d) said at least one carriage with the scanning head being mounted on one of the horizontal beams, and an other carriage with a scanning head being mounted on the other one of the horizontal beams, the carriages being placed in vertical alignment with each other and arranged to be synchronously driven together with each other so that the scanning heads will function together as one unit.

5. A device according to claim 2, wherein the means for providing the planar web supporting surface includes two telescopic members connected to the carriage in such a way that when the carriage with its scanning head moves across the web, one telescopic member will extend itself and the other telescopic member will contract.

6. A device according to claim 5, wherein the telescopic members includes slidable, interconnected lamellae.

7. A device according to claim 1, wherein the means for providing the planar web supporting surface is arranged to remain stationary while performing its web supporting function but to be locally and temporarily deflected where the scanning head traverses the web in such a way that when the carriage with its scanning head moves across the web, the means for providing the web supporting surface is deflected away from the part of the web that for the moment is being scanned.

8. A device according to claim 7, wherein (a) the means for providing the planar web supporting surface includes a plurality of spring-loaded plates that support the web as it passes past the device;

(b) the plates have contact elements;

(c) the carriage has deflecting elements; and (d) the deflecting elements are arranged to co-operate with the contact elements in such a way that when the carriage with its scanning head traverses the web, the deflecting elements will abut the contact elements and press the plates against the spring force away from the path of movement of the scanning head.

9. A device according to claim 7, wherein the means for providing the planar web supporting surface includes a stationary flexible belt extending transversely across the predetermined path of movement of the web at least from one longitudinal edge of the web to the other longitudinal edge of the web, and means for causing the stationary belt to extend in a partial loop around the carriage, so that when the carriage with its scanning head traverses the web, the belt will be deflected away from the part of the web which for the moment is being scanned.

10. A device according to claim 1, further comprising means for inclining the scanning head, and means for inclining the means for providing the web supporting surface, in relation to the horizontal plane.

* * * * *